United States Patent [19]

Haynes, Jr. et al.

[11] 4,434,851

[45] Mar. 6, 1984

[54] METHOD FOR STEAM INJECTION IN STEEPLY DIPPING FORMATIONS

[75] Inventors: Stewart Haynes, Jr.; Donald S. Mims, both of Houston, Tex.

[73] Assignee: Texaco Inc., White Plains, N.Y.

[21] Appl. No.: 375,515

[22] Filed: May 6, 1982

Related U.S. Application Data

[63] Continuation-in-part of Ser. No. 166,658, Jul. 7, 1980, abandoned.

[51] Int. Cl.[3] ..... E21B 43/24

[52] U.S. Cl. ..... 166/272

[58] Field of Search ..... 166/272, 263, 268, 273, 166/274

[56] References Cited

U.S. PATENT DOCUMENTS

| | | | |
|---|---|---|---|
| 3,319,712 | 5/1967 | O'Brien | 166/263 X |
| 3,332,485 | 7/1967 | Colburn | 166/263 X |
| 3,500,915 | 3/1970 | Fitzgerald | 166/272 |
| 3,705,625 | 12/1972 | Whitten et al. | 166/272 X |
| 3,795,278 | 3/1974 | Whitten et al. | 166/272 |
| 3,815,678 | 6/1974 | Terry et al. | 166/272 |
| 3,842,908 | 10/1974 | Thomas et al. | 166/268 |
| 4,260,018 | 4/1981 | Shum et al. | 166/272 |

*Primary Examiner*—George A. Suchfield

*Attorney, Agent, or Firm*—Carl G. Ries; Jack H. Park

[57] ABSTRACT

Oil is produced from a steeply dipping subterranean reservoir containing high viscosity petroleum by injecting a fluid comprising steam into the lower portion of the reservoir and withdrawing the oil from production wells in an intermediate portion of the reservoir while injecting a fluid such as cold water into the updip portion of the reservoir to prevent loss of steam vapor therethrough.

6 Claims, 3 Drawing Figures

METHOD FOR STEAM INJECTION IN STEEPLY DIPPING FORMATIONS

CROSS REFERENCE TO RELATED APPLICATION

This is a continuation-in-part application of copending application Ser. No. 166,658 filed July 7, 1980 (now abandoned) for "Method for Steam Injection in Steeply Dipping Reservoirs".

BACKGROUND OF THE INVENTION

1. Field of the Invention

This invention relates to the recovery of heavy oils and tars from steeply dipping reservoirs penetrated by a plurality of wells and more particularly to steam flooding operations involving the same.

2. Description of the Prior Art

Petroleum reservoirs are found in an almost incredible variety. Those of interest herein are steeply dipping reservoirs, which may or may not outcrop at the surface, and which contain predominantly high viscosity petroleum fractions such as heavy oils and tars.

In a dipping reservoir, one of the most commonly used production techniques is gravity drainage wherein production wells are drilled in the lower portion of the reservoir allowing the oil to flow downdip under the influence of gravity to the producing wells wherefrom the petroleum is either flowed or pumped to the surface. The rate of the downward oil flow is known to be proportional to a term:

$$\frac{\kappa_o}{\mu_o}(\rho_o - \rho_g)\sin\alpha$$

where $\kappa_o$ is the oil permeability, $\mu_o$ is the oil viscosity, $\rho_o$ is the oil density, $\rho_g$ is the gas density and $\alpha$ is the reservoir dip angle.

For reservoirs exhibiting strong gravity drainage characteristics, the value of the above term ranges from about 10 to 200 where $\kappa_o$ is expressed in millidarcies, $\mu_o$ in centipoise, $\rho_o$ and $\rho_g$ in grams per cubic centimeter. It is immediately evident that for a steeply dipping reservoir containing highly viscous petroleum the value of the above term at the initial reservoir temperature will be much less than 10 due to the high value of the oil viscosity. Basic reservoir engineering knowledge indicates that the most effective means to reduce the oil viscosity in such a situation is to inject steam or hot water into the reservoir. The heat from the injected fluids serves to raise the temperature of the reservoir with a resultant reduction in the viscosity of the petroleum contained therein. Consequently, the value of the above term can be increased to within the desirable range of about 10 to 200 thereby creating a favorable gravity drainage condition for the dipping reservoir containing the high viscosity petroleum. Other beneficial effects concommitant with steam injection are thermal expansion of the petroleum, beneficial wetting of reservoir porous media surfaces by the condensed heated water and increased overall pressure within the reservoir.

Nevertheless, the injection of steam into a dipping reservoir presents a number of problems. The natural tendency of the injected steam, due to its low density and high mobility, is to flow upwards in the formation to the updip limit of the reservoir. This updip limit is commonly encountered in the form of a permeability barrier formed by the petroleum itself and/or outcrop of the reservoir at the surface. The injected steam can, however, easily break through this permeability barrier with a extremely detrimental results. If the updip permeability barrier is found in the subsurface, the steam and mobilized hydrocarbons will escape into adjacent formations and be lost. If the updip permeability barrier is found at the surface, steam breakthrough will result in an escape of the gaseous fluid to the atmosphere creating serious environmental pollution problems as well as severely damaging the future production potential for the reservoir.

Heretofore avoidance of steam breakthrough at the updip permeability barrier has been achieved only by those methods which employ extremely conservative steam injection rates and the shutting-off of steam injection wells which were felt to be in too close proximity to the permeability barrier. Such production practices, while prudent, will often leave substantial areas of the reservoir essentially untapped by the steam injection program due to the low injection rates and avoidance of steam injection into the upper portions of the reservoir for fear of a steam breakthrough. There remains an unmet need to utilize the full potential of an efficient steam injection program involving the maximum possible volume of the reservoir and optimal steam injection rates in a dipping heavy oil reservoir while concurrently avoiding the problem of steam breakthrough at the updip permeability barrier.

SUMMARY OF THE INVENTION

Petroleum is recovered from an inclined reservoir containing an updip permeability barrier by a method which comprises injecting a fluid comprising steam into the lower portion of the reservoir through injection wells, injecting cold water at the upper portion of the reservoir nearest the updip permeability barrier and producing petroleum from wells penetrating an intermediate portion of the inclined reservoir.

DESCRIPTION OF THE PREFERRED EMBODIMENT

Figure 1:
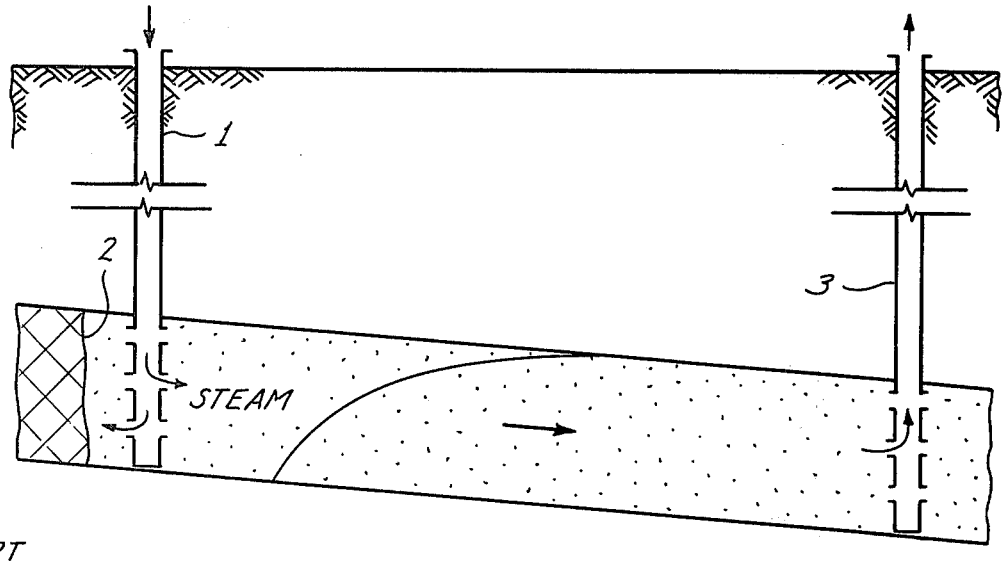
Fig. 1 PRIOR ART
FIG. 1 illustrates a dipping reservoir into which steam is being injected updip to displace petroleum toward a downdip production well. This illustrates how steam injected updip will also invade the permeability barrier in the oil formation, causing loss of sealing effectiveness of the permeability barrier.

There are many petroleum reservoirs throughout the world which are of the type in which our invention is designed to be used; namely, inclined reservoirs containing high viscosity petroleum bounded at the reservoir's upper limit by a permeability barrier. When a petroleum reservoir contains heavy oil or tar sands it is accepted practice that steam or solvent injection procedures or combinations thereof should be used to displace and recover the oil. When steam injection is utilized in dipping formations the steam will tend to flow updip and can easily breakthrough the permeability barrier at the updip limit of the reservoir. Our invention is therefore to provide an improved steam injection program for inclined high viscosity petroleum reservoirs comprising injecting steam into the lower portion of the reservoir, injecting cold water into the upper portion of the reservoir immediately adjacent to the undip permeability barrier and producing petroleum from production wells in an intermediate portion of the reservoir.

If the problem of updip steam breakthrough could be ignored, steam injection at the updip limit of the reservoir represents the most efficient technique for producing an inclined high viscosity petroleum reservoir. Injection of the steam into the upper portion of the reservoir will serve to create a "gas cap" which will gradually expand downwards through the inclined reservoir mobilizing and displacing the petroleum downwards and also tending to form an "oil bank", a very useful phenomenon in which a more or less continuous front of mobilized petroleum containing a high proportion of lighter hydrocarbon fractions which act as solvent sweeps ahead of the advancing steam front greatly augmenting the oil recovery process. Nevertheless the problem of updip steam breakthrough does exists and increases in probability as the locus of the steam injection approaches the updip limit of the reservoir.

The updip limit of the reservoir may take several forms. Most commonly the updip limit of the reservoir will be marked by a permeability barrier to the further upward migration of the hydrocarbons contained within the reservoir. In many instances, this updip limit will occur at the surface outcrop of the formation containing the petroleum wherein the permeability barrier takes the form of a tar deposit in which gradual distillation and chemical weathering have combined to form an impermeable tar deposit. Updip permeability barriers can also be found in the subsurface, although they are less common. Indeed, in some situation the updip limit of the high viscosity petroleum reservoir will not be marked by a permeability barrier as such but rather by the presence, immediately adjacent updip, of a porous permeable hydrocarbon-poor zone in fluid communication with the hydrocarbon-rich reservoir immediately downdip. In the surface outcrop situation steam breakthrough would result in irreparable damage to the reservoir, loss of pressure within the reservoir and severe atmospheric environmental pollution. In the two subsurface cases mentioned, steam breakthrough into the regions above the updip limit of the reservoir, although probably not resulting in atmospheric pollution would require extensive steam injection and would probably not ever be able to mobilize and transport the petroleum towards the downdip production wells.

FIG. 1 illustrates the problem of steam injection updip in a dipping reservoir. It can clearly be seen that the close proximity between steam injection well 1 and permeability barrier 2 will cause rapid and immediate contact between the injected steam and the permeability barrier. If the barrier is in the form of a tar plug in the upper extremity of the hydrocarbon reservoir, the injected steam will dissolve the tar and open communication between the reservoir and the remaining updip structure, which may cause venting of the steam to the surface. Whether or not escape to the surface occurs, a substantial amount of steam will be lost as a consequence of dissolving the tar plug permeability barrier 2. The steam that does not pass into and through the permeability barrier displaces oil in a downward direction toward production well 3, where it can be recovered to the surface of the earth. While downward displacement with steam is an efficient displacement mechanism, a substantial amount of steam will be lost through the permeability barrier 2, which is detrimental to the economics of the steam drive process, and also reduces the pressure in the steam saturated interval above the oil bank, which reduces the drive efficiency of the downward steam displacement process.

Figure 2:
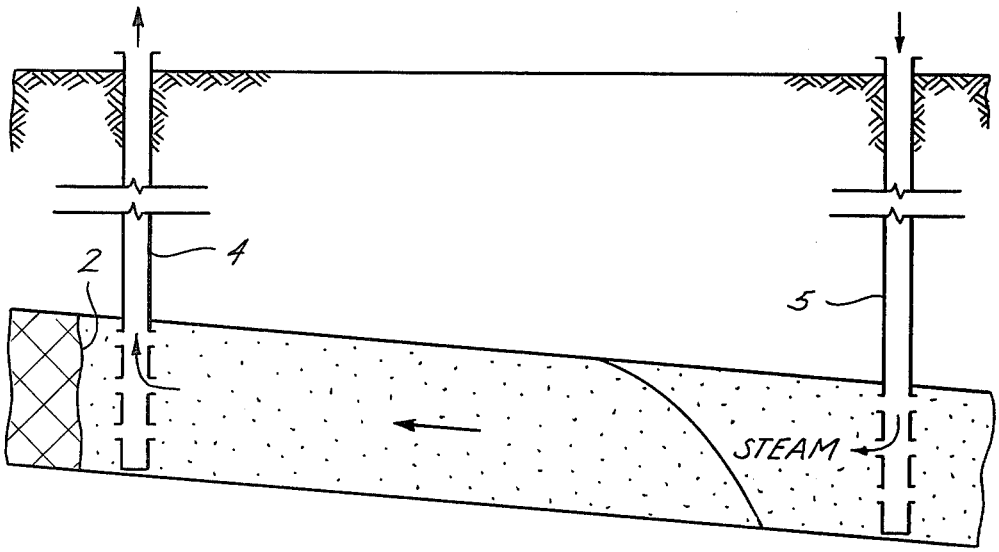
FIG. 2 illustrates in cross sectional view a dipping reservoir being subjected to steam flooding in which steam is injected downdip with oil production being taken updip in the reservoir. While the problem of steam attacking the permeability barrier is avoided, the process is quite ineffective because of the tendency for steam to move rapidly to the upper portion of the reservoir, which is more pronounced in the dipping reservoir than in a essentially horizontal reservoir. The process shown in FIG. 2, while not causing rapid loss of sealing effectiveness of the permeability barrier, will achieve very poor vertical conformance due to steam override.

FIG. 2 illustrates the problem which would result if the injection production wells were reversed. In the embodiment illustrated in FIG. 2, injection well 4 is located updip and production well 5 is positioned downdip in the oil reservoir. Although steam does not contact the tar barrier 2 in this instance as rapidly as it does in FIG. 1, injection of steam downdip in a dipping reservoir is an inefficient displacement mechanism because steam override occurs so rapidly and, compounded by the geometry of the reservoir, results in very poor vertical conformance of the steam drive recovery process.

Figure 3:
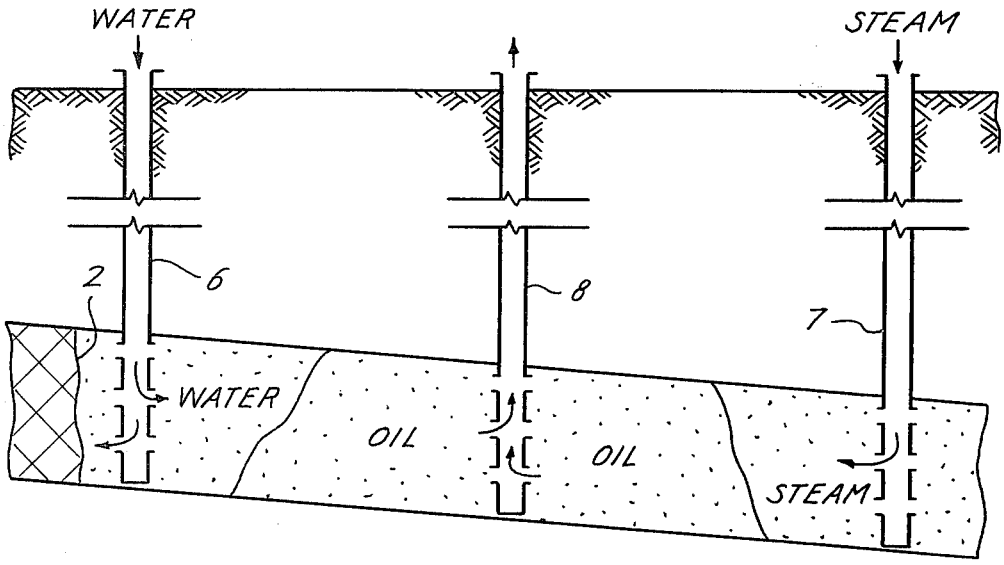
FIG. 3 illustrates a dipping reservoir being exploited by steam drive according to the process of our invention, with cold water injection being accomplished updip at or near the permeability barrier, steam injection being applied downdip of the reservoir, with oil production being taken from a well in communication with the reservoir at a depth intermediate between the updip cold water injection well and the downdip steam injection well.

FIG. 3 illustrates a steam drive process according to our invention applied to a similar reservoir to that shown in the preceding figures. Cold water injection is applied at the upper most well 6, which is preferably located at or near the permeability barrier 2. Steam injection well 7 is located at the downdip position, with production well 8 positioned intermediate between steam injection well 7 and water injection well 6. There is no requirement of course that the production well be at precisely the midpoint or be in communication with a depth of the reservoir which is approximately equal distance between the perforations of the water injection well 6 and the steam injection well 7, although this is a convenient embodiment of our process.

The temperature of water being injected into the updip portion of the reservoir (e.g. via well 6 in FIG. 3) is critical to the proper functioning of our invention. Steam vapor migrating updip contains both sensible and latent heat, which must be balanced by sufficient heat gain to the injected cold water to condense steam vapor in the updip portion of the reservoir if steam loss from the reservoir is to be avoided. The lower the water temperature, the less volume of water is required to condense migrating steam vapor in the updip portion of the water. Any heating of water injected into the updip portion of the reservoir in counterproductive to the proper functioning of our invention. If water being injected into the reservoir is above surface ambient temperature, such as when produced water or the liquid phase separated from low quality steam must be utilized, every effort should be made to allow the water temperature to equilibrate with surface ambient temperature. This can usually be done by storing such hot water on the surface for a period of time in a tank or pond sufficient for the water temperature to reach surface temperature or at least be cooled sufficiently to ensure its temperature is sufficiently low to cause steam condensation to occur in the portion of the reservoir into which it is injected. Our process will only be successful if the water temperature at the injection well head is at least 75° F. (41.8° C.) and preferably 100° F. (55.56° C.) *below* the temperature at which saturated steam vapor condenses to liquid in the formation. (e.g. the steam dew point at formation pressure). If the water temperature exceeds these values, much greater volumes of water must be injected into the formation to condense steam vapor to prevent its escape. As the water temperature approaches the steam dew point it becomes impossible to inject, sufficient volume to cause condensation and so the benefit of our invention is lost.

Although some cooling of the injected water occurs due to heat loss through the injection well during injection, this cooling is not sufficient to ensure successful operation of our invention unless the temperature of the water at the injection wellhead is at least 75° F. and preferably 100° F. below the steam dew point at formation conditions.

Our invention prevents the problem of steam breakthrough at the updip limit of the reservoir by injecting a fluid whose temperature is substantially less than the temperature at which steam condenses to water liquid at formation pressure, preferably cold water, at the updip limit of the reservoir, thereby forming a barrier to the further upward migration of injected steam from below by the condensing action of the cold water upon the steam. The thermal recovery fluid, preferably steam, is injected at the lower portion of the reservoir and migrates updip partially condensing into hot water along the way. The remainder of the steam condenses into hot water when it enters the region of cold water injection at the updip limit of the reservoir. This hot water along with the petroleum mobilized by the action of the steam and the hot water will now migrate downdip towards the production wells which are disposed intermediate of the steam and cold water injection wells. In this manner a type of fluid movement cell is formed wherein the steam injected at the lower portion of the reservoir migrates updip while hot water and mobilized petroleum migrate downdip towards the intermediate producing wells.

Thus, by the practice of the method of our invention, inclined reservoirs containing high viscocity petroleum can be efficiently and safely produced by steam injection methods. In reservoirs sealed at their updip limits by a surface tar outcrop, steam breakthrough to the atmosphere at the surface can be prevented. Also, in those inclined reservoirs whose updip reservoir limit is found in the subsurface, the minimum necessary amount of steam can be utilized with effective results since steam breakthrough into the hydrocarbon-poor zones updip from the reservoir will be prevented by the cold water quench zone at the updip limit of the reservoir.

EXPERIMENTAL SECTION

Laboratory tests were undertaken to study the effect of reservoir dip angle on oil recovery during steam drive enhanced oil recovery processes. After experimentation with a relatively short, 17 centimeter (7-inch) linear cell having a length-to-diameter ratio of 5, it was determined that a greater length-to-diameter ratio cell was necessary to minimize end effects and properly define the response of steam displacement to dip angle. A special cell was constructed which is 91.4 centimeters (36 inches) in length with a ratio of length-to-diameter of 26. Steam drive displacement processes were studied using this cell with 12.5 degree API crude and with 33.0 degree API crude using updip and downdip injection at various reservoir dip angles. The cells were packed with a mixture of 170–230 mesh clean silica sand, saturated with deionized water which was then displaced as the cell was resaturated with the crude oil being studied. The initial oil saturation achieved by the hydraulic packing ranged from 45–53% of the pore space of the sand-packed cell and porosities varied from 0.39 to 0.41 $m^3/m^3$. Steam was injected at a constant feed-water rate of 60 to 120 gallons per hour. Thermocouples were connected to the center, inlet, and outlet locations of the cell which was then wrapped with heating tape and insulated to reduce heat-loss effects. The cell was heated to a temperature of 40 degrees C. (105 degrees F.) prior to each steam-flood. The inlet line was superheated by 3–5 degrees C. (5–10 degrees F.) to compensate for heat losses. Steam injection was continued for a minimum of 1 pore volume after steam breakthrough occurred at the effluent end of the cell. After each test was completed, the cell was disassembled and residual sand samples were removed. Dean-Stark extractions were used to determine residual oil saturation for each 30.5 centimers (12-inch) section of the sand pack. Results are summarized in Table 1 below:

TABLE I

| Run No. | Injection Location | Dip Angle | Inj. Rate (g/h) | $S_{oi}$ $m^3/m^3$ | $S_{or}$ $m^3/m^3$ | Avg. $E_R$ $m^3/m^3$ | Vp at SBT |
|---|---|---|---|---|---|---|---|
| | | | 12.5° API CRUDE OIL | | | | |
| 1 | N/A | Horizontal | 120 | .457 | .105 | .770 | 1.90 |
| 2 | Downdip | 48° | " | .503 | .130 | .742 | 1.82 |
| 3 | Updip | 48° | " | .485 | .102 | .790 | 2.37 |
| 4 | Downdip | 90° | " | .535 | .132 | .753 | 1.94 |
| 5 | Updip | 90° | " | .487 | .083 | .830 | 2.22 |
| 6 | N/A | Horizontal | 60 | .458 | .125 | .727 | 2.22 |
| 7 | Downdip | 48° | " | .478 | .176 | .631 | 1.92 |
| 8 | Downdip* | 48° | 120 | .526 | .096 | .818 | 1.55 |
| | | | 33° API CRUDE OIL | | | | |
| 9 | N/A | Horizontal | 120 | .461 | .050 | .891 | 1.29 |
| 10 | Downdip | 35° | " | .471 | .058 | .883 | 1.26 |
| 11 | Updip | 35° | " | .500 | .043 | .913 | 1.42 |
| 12 | Downdip | 90° | " | .480 | .082 | .870 | 1.28 |
| 13 | Updip | 90° | " | .451 | .066 | .854 | 1.34 |
| 14 | Updip | 90° | " | .465 | .067 | .851 | 1.44 |

TABLE I-continued

| Run No. | Injection Location | Dip Angle | Inj. Rate (g/h) | $S_{oi}m^3/m^3$ | $S_{or}m^3/m^3$ | Avg. $E_Rm^3/m^3$ | Vp at SBT |
|---|---|---|---|---|---|---|---|
| 15 | Updip | 35° | " | .501 | .055 | .892 | 1.22 |

*Initial Gas Saturation present

It can be seen from the data in Table I that in runs 2 and 3 using 48° dip angle, updip injection (downward displacement) was somewhat more effective than downdip injection. Runs 1 and 6 were conducted with a cell in a horizontal arrangement for purposes of establishing a base result. Runs 4 and 5 were conducted with the cell in essentially a vertical orientation to simulate the worst possible arrangement. In the series of runs conducted with 33° API crude oil, updip injection was more effective than downdip injection at the 35° dip angle, which corresponded to the dip angle of the reservoir being studied. Injection pressures were higher in all of the updip injection tests indicating more efficient banking of the oil was occurring. These data clearly indicate that updip injection is a highly desirable steam drive oil recovery method, providing updip injection does not cause dissolution of the updip permeability barrier, which is very likely if steam contacts tar plug permeability barriers. The data clearly show that dip angle affects oil recovery in heavy crude reservoirs, and that updip injection is more efficient than downdip injection. Our tests indicated that reservoir dip angle has relatively little effect on the recovery of 33° API crude oil.

Various modifications to the basic method of our invention are possible and in many cases desirable. For example, it may be desirable to include various chemical additives to the injected fluids such as solvents, solubilizers, surfactants and/or caustic chemicals to enhance the oil recovery efficiency of the process as a whole. In one embodiment the production or injection intervals within any given well in the reservoir may be varied vertically to achieve greater vertical sweep efficiencies during the course of the injection/production program. These and other modifications to the basic method of our invention are left to the experienced practitioner in the field.

The above examples and embodiments represent the best mode contemplated by the inventors for the practice of the invention. Nevertheless, they should not be considered as limitative to the true spirit and scope of the invention which is to be found in the claims listed below.

We claim:

1. A method for recovering petroleum from an inclined reservoir containing high viscosity petroleum comprising:

(a) injecting a thermal recovery fluid comprising steam vapor into a steam injection zone in the lower portion of the reservoir through a thermal recovery fluid injection well;

(b) injection cold water whose temperature is at least 75° F. (41.8° C.) below the temperature at which steam vapor condenses to water liquid at formation pressure into a zone within the reservoir immediately adjacent the updip limit of the reservoir via a fluid injection well; and (c) recovering petroleum from the formation via a production well located in a zone intermediate the wells of steps (a) and (b).

2. A method as recited in claim 1 wherein the thermal recovery fluid consists of steam.

3. A method as recited in claim 1 wherein the production well of step (c) communicates with a portion of the formation at a depth intermediate between the depth of the thermal recovery fluid injection well of step (a) and the fluid injection well of step (b).

4. A method as recited in claim 1 wherein the temperature of the cold water of step (b) is at least 100° F. (55.56° C.) below the temperature at which steam vapor condenses to water liquid at formation pressure.

5. A method as recited in claim 1 wherein the water of (b) is at a temperature about equal to surface ambient temperature.

6. A method as recited in claim 1 wherein the volume rate of injecting the cold water of (b) is at least sufficient to condense substantially all of the steam vapor in the updip portion of the reservoir to water liquid.

* * * * *